US010820669B2

(12) United States Patent
Chen

(10) Patent No.: US 10,820,669 B2
(45) Date of Patent: Nov. 3, 2020

(54) STRUCTURE OF WATCHCASE AND WATCH STRAP WHICH ARE FIXED BY PRESSING STRUCTURE ENGAGING WITH ELASTIC PIN

(71) Applicant: Y.F. COMPANY LITMITED, Dongguan (CN)

(72) Inventor: Yanning Chen, Dongguan (CN)

(73) Assignee: Y.F. COMPANY LITMITED, Dongguan (CN)

( * ) Notice: Subject to any disclaimer, the term of this patent is extended or adjusted under 35 U.S.C. 154(b) by 0 days.

(21) Appl. No.: 16/541,188

(22) Filed: Aug. 15, 2019

(65) Prior Publication Data

US 2020/0154835 A1 May 21, 2020

(30) Foreign Application Priority Data

Nov. 17, 2018 (CN) ..... 2018 1 1370317

(51) Int. Cl.
*A44C 5/14* (2006.01)
*G04B 37/14* (2006.01)

(52) U.S. Cl.
CPC ..... *A44C 5/147* (2013.01); *G04B 37/1486* (2013.01)

(58) Field of Classification Search
CPC ..... A44C 5/147; G04B 37/1486
See application file for complete search history.

(56) References Cited

U.S. PATENT DOCUMENTS 4,536,922 A * 8/1985 Brassoud ..... A44C 5/14 24/265 B
7,380,935 B2 * 6/2008 Ifergan ..... G02C 5/10 351/153
8,789,245 B2 * 7/2014 Leger ..... A44C 5/246 24/265 WS
8,918,965 B2 * 12/2014 Kaltenrieder ..... A44C 5/24 24/68 J
9,357,818 B2 * 6/2016 De Oliveira ..... A44C 5/14
2003/0020867 A1 * 1/2003 Dei Negri ..... G02C 5/2245 351/153
2005/0078272 A1 * 4/2005 Quehin ..... G02C 5/2227 351/153
2014/0208546 A1 * 7/2014 Lee ..... A44B 11/24 24/3.2
2017/0265607 A1 * 9/2017 Hatanaka ..... A44C 5/14
2019/0021457 A1 * 1/2019 Vuille ..... G04B 37/1486
2019/0069646 A1 * 3/2019 Voumard ..... A44C 5/147
(Continued)

*Primary Examiner* — Jason W San
(74) *Attorney, Agent, or Firm* — Hemisphere Law, PLLC; Zhigang Ma

(57) ABSTRACT

The application relates to a structure of a watch strap and a watchcase which are fixed by a pressing structure engaging with an elastic pin. The watchcase is provided with a connection head, the connection head is provided with an elastic pin fixing hole adjacent to an end portion of the connection head and for disposing an elastic pin structure. An end portion of the watch strap is provided with the pressing structure and a connection head receiving recess. An end portion of the elastic pin structure in the elastic pin fixing hole is inserted into an elastic pin engaging hole defined in the watch strap by spring elasticity, an end portion of the pressing structure abuts against the end portion of the elastic pin structure in the elastic pin engaging hole. The structure is simple and practical.

1 Claim, 14 Drawing Sheets

(56) References Cited

U.S. PATENT DOCUMENTS

| | | | | |
|---|---|---|---|---|
| 2019/0191828 | A1* | 6/2019 | Wang | G04B 37/1486 |
| 2019/0350319 | A1* | 11/2019 | Li | A44C 5/145 |
| 2019/0361402 | A1* | 11/2019 | Markan | G04B 37/1486 |
| 2020/0064778 | A1* | 2/2020 | Guillot | G04B 37/1446 |

* cited by examiner

STRUCTURE OF WATCHCASE AND WATCH STRAP WHICH ARE FIXED BY PRESSING STRUCTURE ENGAGING WITH ELASTIC PIN

FIELD OF THE DISCLOSURE

The disclosure relates to the field of wrist watch technologies, and more particularly to a structure of a watchcase and a watch strap which are fixed by a pressing structure engaging with an elastic pin.

BACKGROUND

A conventional watch strap is difficult to be disassembled and replaced, and there are disadvantages in that other accessories would be scratched when it is disassembled or replaced. Because the conventional watch strap has a spring needle structure, and needs other disassembly tools to squeeze the spring needle structure thereby to take out the watch strap. It is very inconvenient to replace the watch strap in such a way.

SUMMARY

The disclosure provides a structure of a watchcase and a watch strap which are fixed by a pressing structure engaging with an elastic pin, it is easy and convenient to replace the watch strap without other tools. The structure uses a pressing structure engaged with an elastic pin to fix the watch strap, and the watch strap is easy to be disassembled and replaced. It fundamentally overcomes the shortcomings of the conventional watch strap that hard to replace and easy to scratch other accessories when replacing. The structure facilitates to disassemble and replace the watch strap. It is not only suitable for rubber straps, but also suitable for metal connecting straps and metal mesh straps, with advantages of simple, practical, and easy to disassemble and replace.

To achieve the above object, technical solutions of the disclosure are provided as follows.

The disclosure provides a structure of a watch strap and a watchcase fixed with a pressed elastic pin engaging manner. The watchcase is provided with a connection head, the connection head is provided with an elastic pin fixing hole adjacent to an end portion of the connection head and for disposing an elastic pin structure. An end portion of the watch strap is provided with a pressing structure and a connection head receiving recess, an end portion of the elastic pin structure disposed in the elastic pin fixing hole is inserted into an elastic pin engaging hole defined on the watch strap by spring elasticity, an end portion of the pressing structure abuts against the end portion of the elastic pin structure in the elastic pin engaging hole.

In one embodiment, the pressing structure includes a pressing surface, a pressing convex structure and a pressing clasp, the pressing convex and the pressing clasp are positioned at a side opposite to the pressing surface, the watch strap is provided with a pressing counterbore, a pressing clasp receiving hole and the elastic pin engaging hole matched with the pressing structure, and a U-shaped groove is provided in the connection head to accommodate the pressing clasp.

In one embodiment, the connection head comprises two elastic pin structures, and the pressing structure comprises two pressing convexes matched with the two elastic pin structures.

In one embodiment, the elastic pin structure includes an elastic pin, an elastic pin fixing column, and a spring for connecting an end portion of the elastic pin to the elastic pin fixing column, the elastic pin is positioned at a bottom end of the elastic pin structure, an elastic pin buckle convex matched with a limiting portion is provided at a connection of the elastic pin with the spring, and the elastic pin fixing column is clamped in the elastic pin fixing hole.

In one embodiment, a height of the pressing convex structure is equal to a depth of the elastic pin engaging hole, and a tail end of the elastic pin is a curved surface structure.

The disclosure has the beneficial effects as follows.

1. The structure of the disclosure can be applied to any wrist watch needed to disassemble or replace the watch strap.

2. The structure of the disclosure is simple, practical, and easy to be disassembled. The watch has good stability performance when worn normally, because the elastic pin structure makes the connection head tightly fixed in the elastic pin engaging hole. If the pressing structure is pressed to enforce the elastic pin structure back into the connection head under an external force, then the watch strap can be separated from the watch easily.

Figure 1:
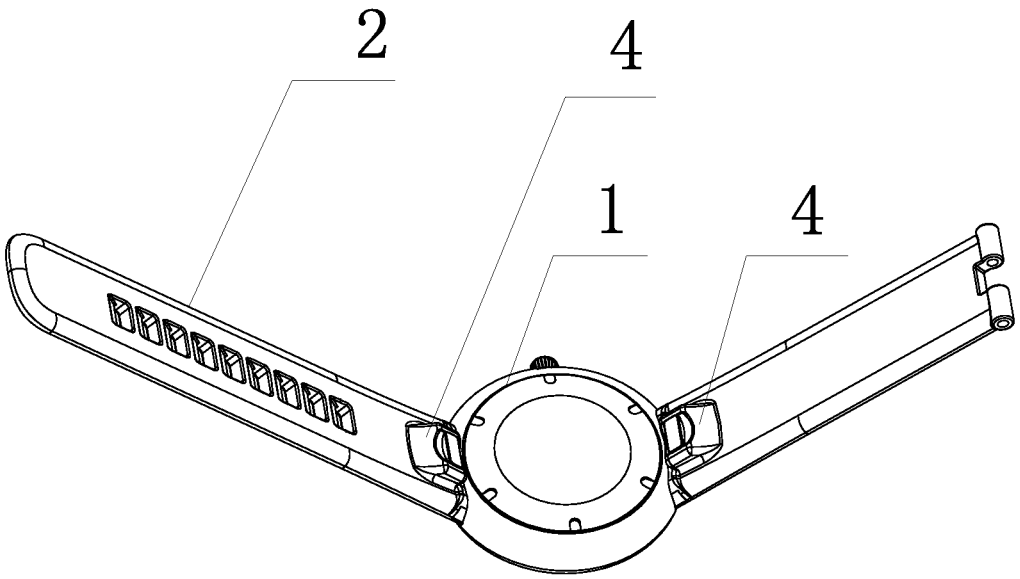
FIG. 1 is a schematic view of a structure of the disclosure.

Descriptions of reference numerals: 1—watchcase; 2—watch strap; 3—elastic pin structure; 4—pressing structure; 5—connection head; 6—limiting portion; 7—pressing surface; 8—pressing convex; 9—pressing clasp; 10—elastic pin fixing column; 11—pressing counterbore; 12—pressing clasp receiving hole; 13—elastic pin engaging hole; 14—connection head receiving recess; 15—elastic pin fixing hole; 16—U—shaped groove; 17—elastic pin buckle convex; 18—elastic pin; 19—spring.

DETAILED DESCRIPTION OF PREFERRED EMBODIMENTS

The technical solutions in the embodiments of the disclosure are clearly and completely described in the following with reference to the accompanying drawings in the embodiments of the disclosure. It is obvious that the described embodiments just are a part of the embodiments, not all embodiments of the disclosure. All other embodiments could be obtained by those skilled in the art based on the embodiments of the present disclosure without creative efforts are within the scope of the present disclosure.

Figure 2:
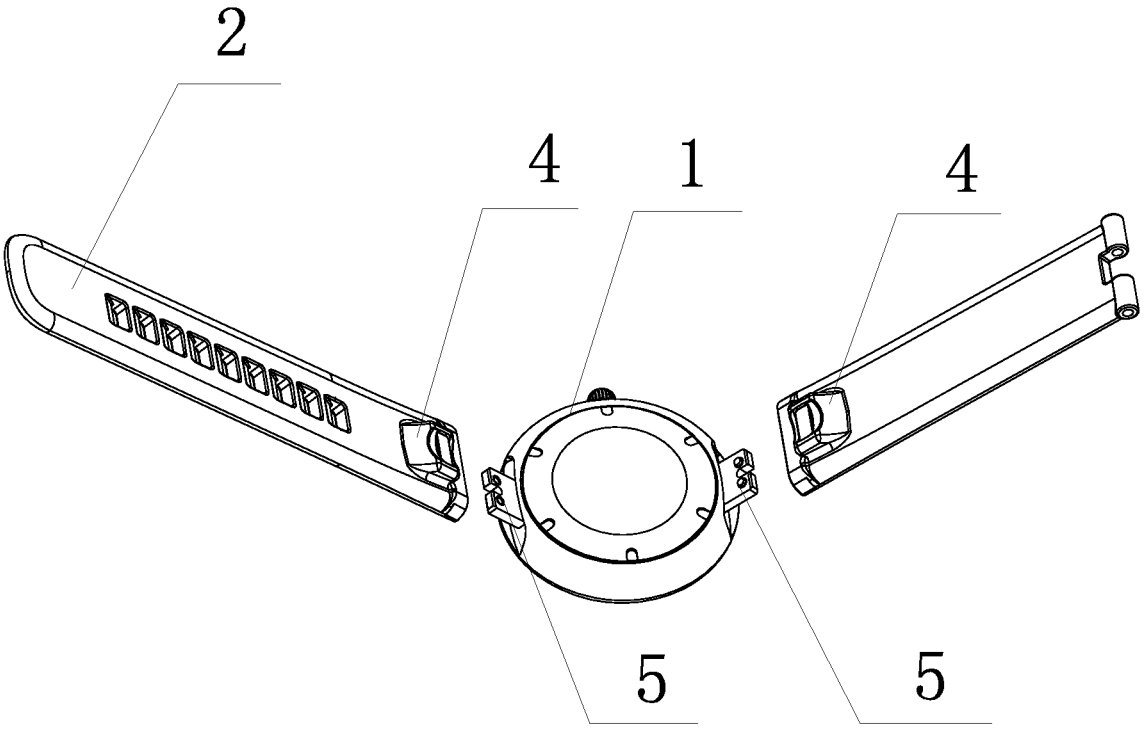
FIG. 2 is a schematic structural view of FIG. 1 in a disassembled state, showing a watchcase and a watch strap are separated.
Figure 3:
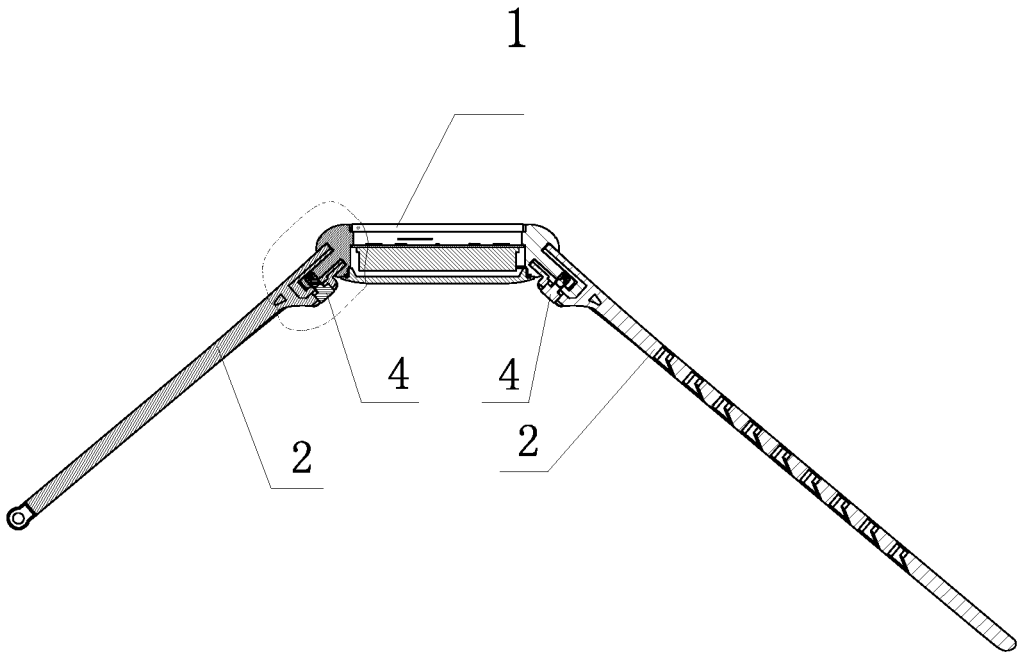
FIG. 3 is a cross sectional view of the structure of the disclosure in an assembled state.
Figure 4:
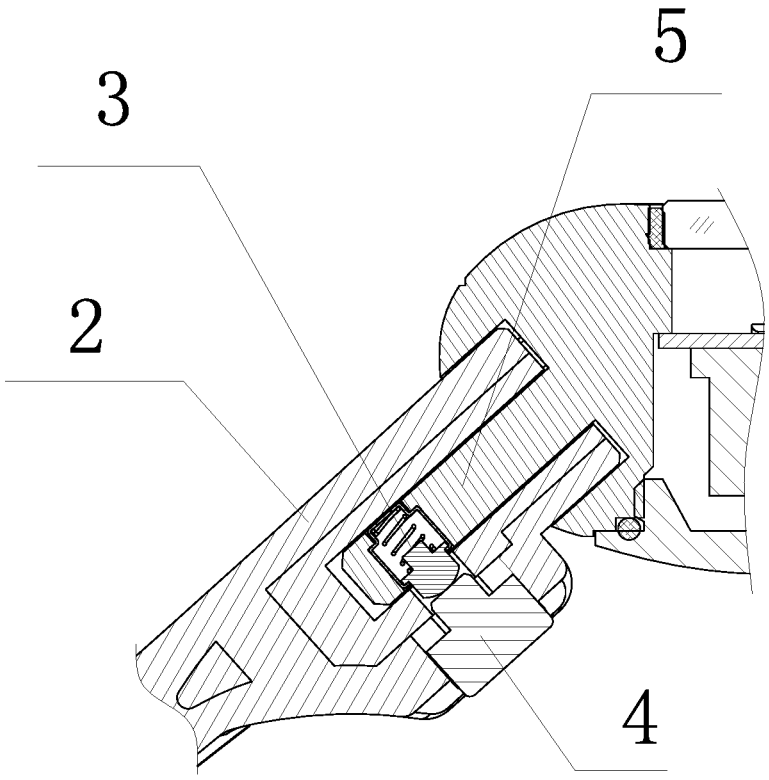
FIG. 4 is an enlarged schematic view of a dotted portion of FIG. 3.
Figure 5:
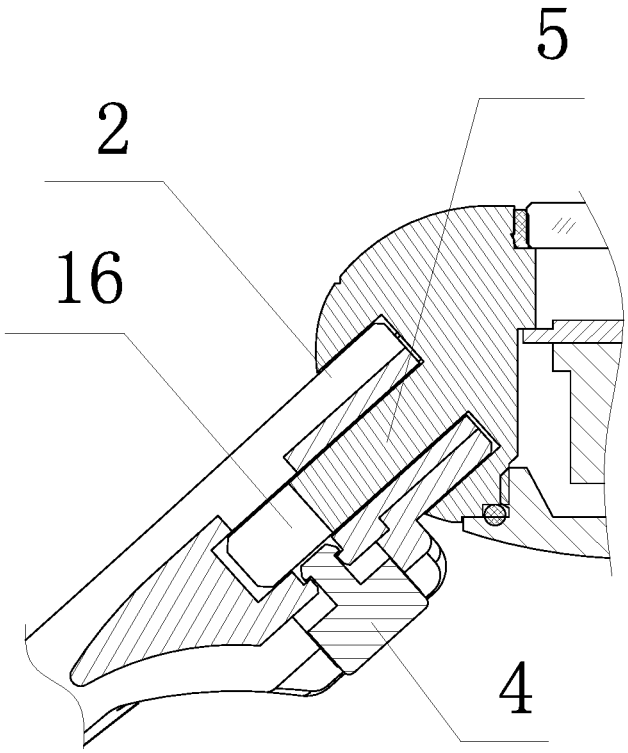
FIG. 5 is a schematic structural view showing a pressing clasp of FIG. 4 in an assembled state.
Figure 6:
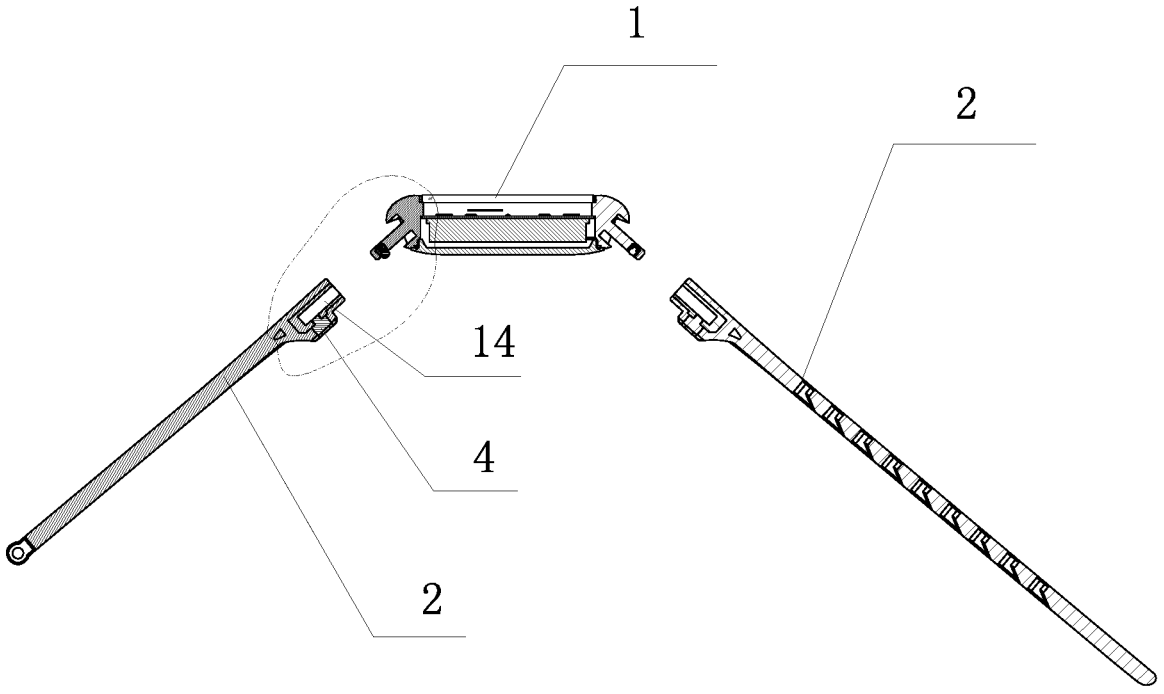
FIG. 6 is a cross sectional view showing the watchcase and a watch strap are separated.
Figure 7:
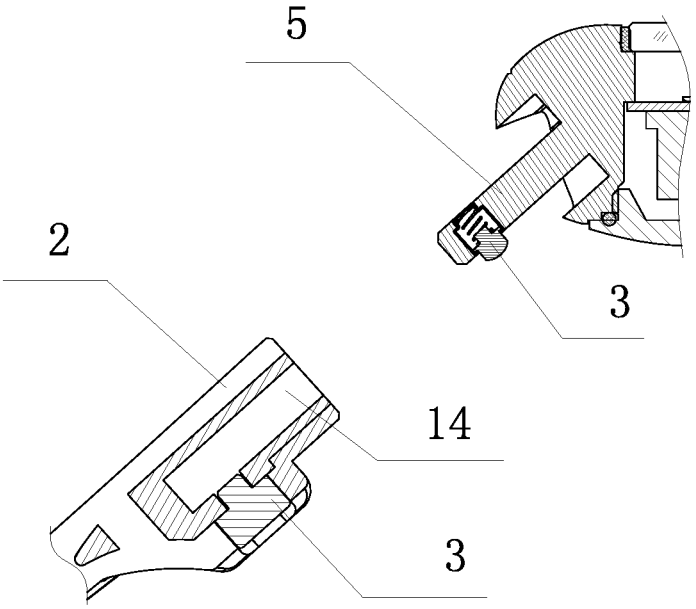
FIG. 7 is an enlarged schematic view of a portion of FIG. 6.
Figure 8:
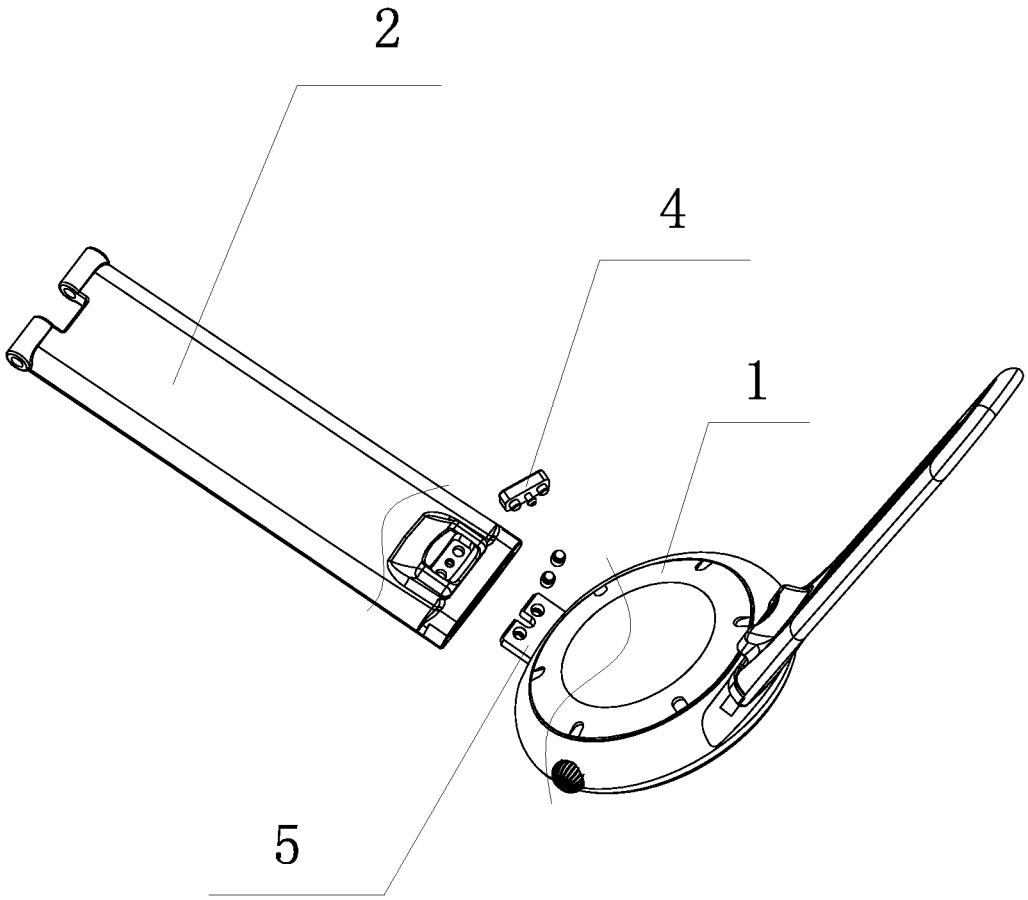
FIG. 8 is an exploded schematic view of FIG. 1.
Figure 9:
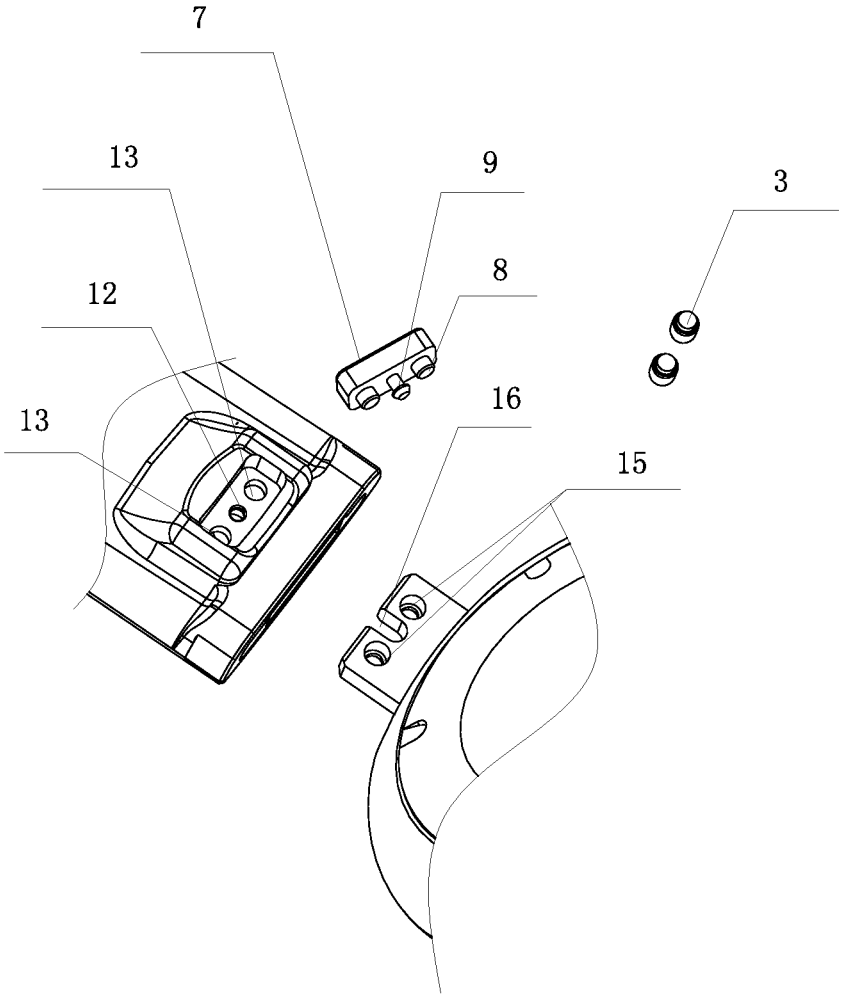
FIG. 9 is an enlarged schematic view of a portion of FIG. 8.
Figure 10:
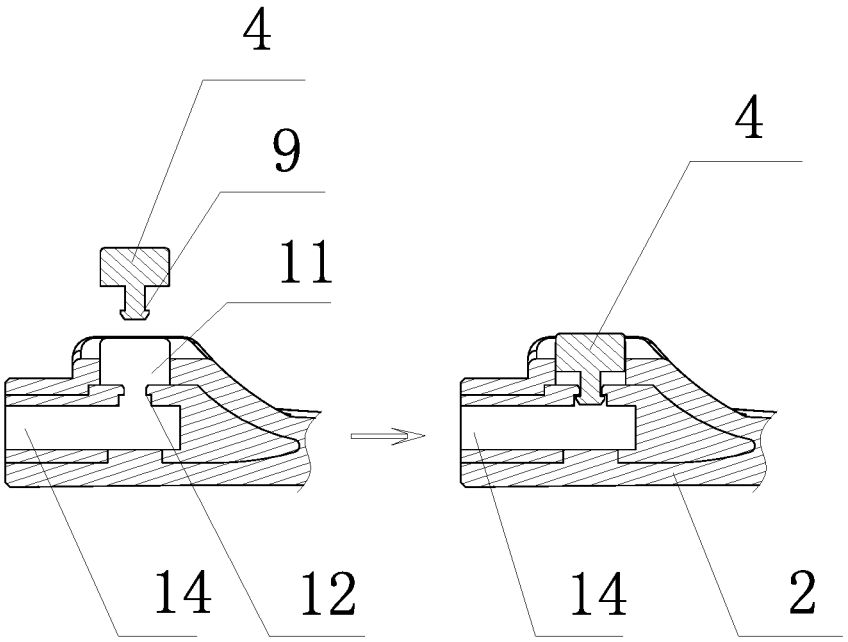
FIG. 10 is a schematic diagram showing a process of a pressing structure is engaged with the watch strap.
Figure 11:
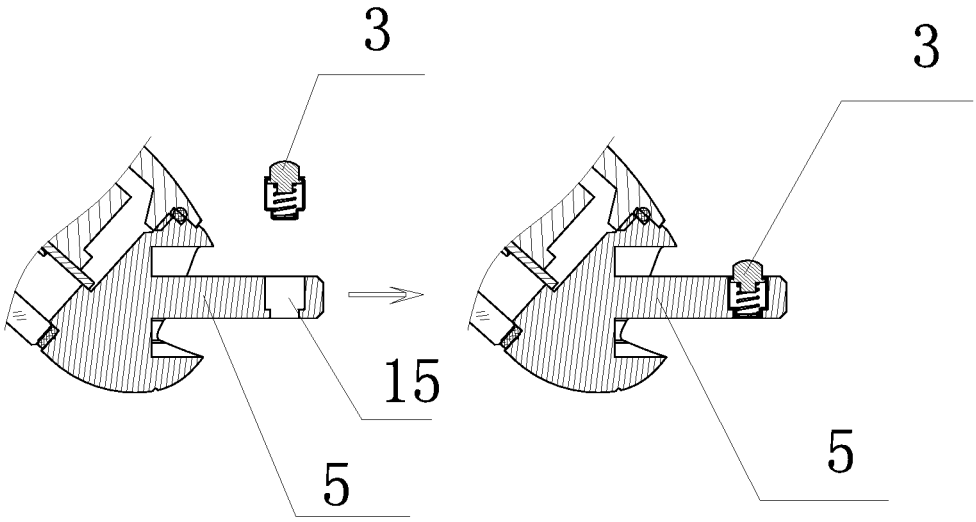
FIG. 11 is a schematic diagram showing a process of an elastic pin structure is engaged with an elastic pin fixing hole.
Figure 12:
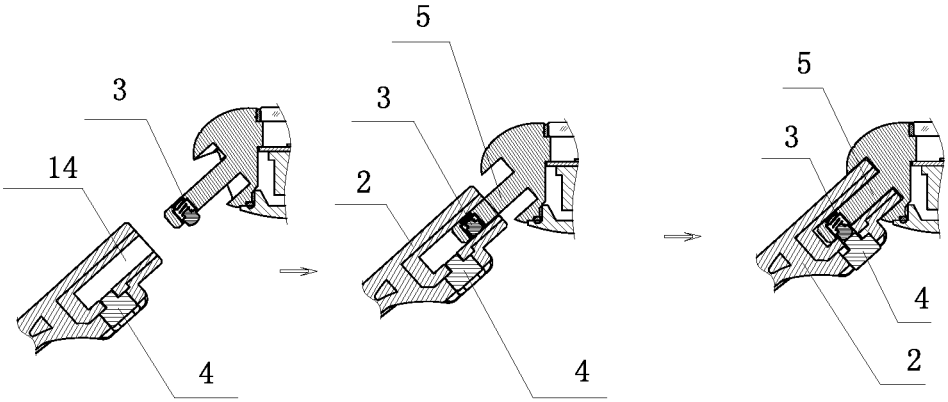
FIG. 12 is a schematic structural view of the watchcase and the watch strap in an assembled state.
Figure 13:
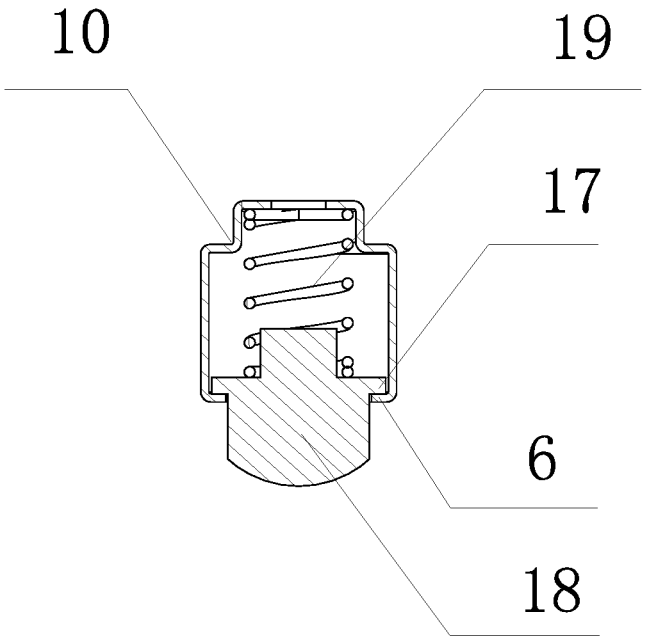
FIG. 13 is a schematic structural view of the elastic pin structure.
Figure 14:
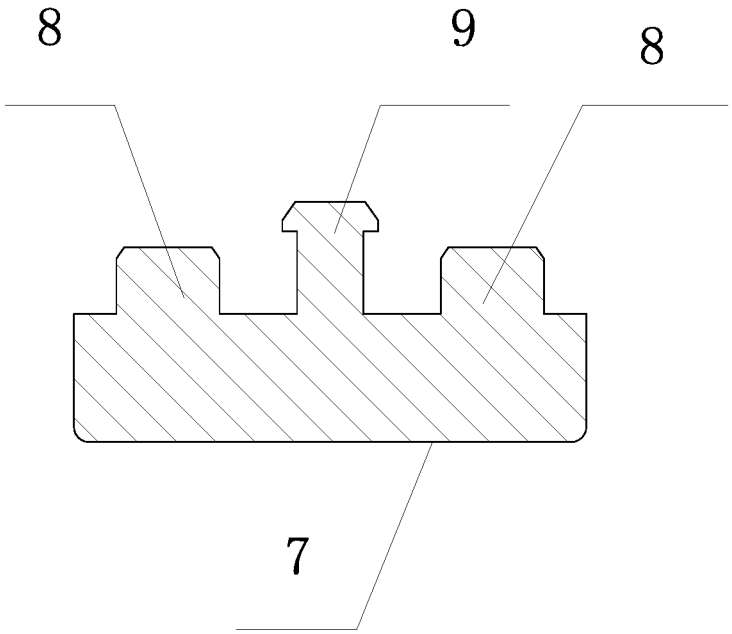
FIG. 14 is a schematic structural view of the pressing structure.

Referring to FIGS. 1-12, the disclosure provides a structure of a watch strap and a watchcase which are fixed by a pressing structure engaging with an elastic pin. The structure includes a watch strap 1 and a watchcase 6. One of ordinary skill in the art understands that the watch strap 2 may include two sections that capable of being snap-fitted together or separated, and the watch strap 2 may also just include one section capable of being folded or unfolded. The watchcase 1 is provided with a connection head 5, the connection head 5 is provided with an elastic pin fixing hole 15 adjacent to an end portion of the connection head 5 and for disposing an elastic pin structure 3. An end portion of the watch strap 2 is provided with a pressing structure 4 and a connection head receiving recess 14, an end portion of the elastic pin structure 3 disposed in the elastic pin fixing hole 15 is inserted into an elastic pin engaging hole 13 defined on the watch strap 2 by spring elasticity. An end portion of the pressing structure 4 abuts against the end portion of the elastic pin structure 3 in the elastic pin engaging hole 13. The elastic pin structure 3 includes an elastic pin 18, an elastic pin fixing column 10, and a spring 19 for connecting an end portion of the elastic pin 18 to the elastic pin fixing column 10, the elastic pin 18 is positioned at an end of the elastic pin structure 3. An elastic pin buckle convex 17 matched with a limiting portion 6 is provided at a connection of the elastic pin 18 with the spring 19, and the elastic pin fixing column 10 is clamped in the elastic pin fixing hole 15. A height of a pressing convex structure 8 is equal to a depth of the elastic pin engaging hole 13, and a tail end of the elastic pin 18 is a curved surface structure.

The pressing structure 4 includes a pressing surface 7, the pressing convex 8 and a pressing clasp 9, the pressing convex 8 and the pressing clasp 9 are positioned at a side opposite to the pressing surface 7. The watch strap 2 is provided with a pressing counterbore 11, a pressing clasp receiving hole 12 and the elastic pin engaging hole 13 all matched with the pressing structure 4, and a U-shaped groove 16 is provided on the connection head 5 to avoid the pressing clasp 9.

The connection head 5 may be disposed with two elastic pin structures 3, and the pressing structure 4 includes two pressing convexes 8 matched with the two elastic pin structures 3.

In summary, the disclosure can replace the watch strap very conveniently without other accessory tools. When the pressing structure is pressed to enforce the elastic pin structure back into the elastic pin fixing hole, the connection head of the watchcase could be pulled out from the watch strap, in other words, a fixing structure between the watchcase ant the watch strap is opened. At this time, the watch strap can be replaced and would not cause any damage to the watchcase or the watch strap. The structure is simple and practical.

In an alternative embodiment, the watch strap is provided with the connection head, the watchcase is provided with the pressing structure, the watch strap and the watchcase can be fixed together in a same manner with a same principle as described above, this is a conventional replacement method of the present disclosure.

Skilled person in the art may make some modifications and substitutions under the teaching of the technical solution of the disclosure. These modifications or substitutions, which are based on the essences of the technical solution of disclosure, are still within the scope of the technical solutions of the embodiments of the disclosure.

What is claimed is:

1. A structure of a watch strap and a watchcase which are fixed by a pressing structure engaging with an elastic pin, comprising: the watchcase (1) and the watch strap (2), wherein the watchcase (1) is provided with a connection head (5), the connection head (5) is provided with elastic pin fixing holes (15) adjacent to an end portion of the connection head (5) and respectively for disposing elastic pin structures (3); wherein an end portion of the watch strap (2) is provided with the pressing structure (4) and a connection head receiving recess (14); wherein an end portion of the elastic pin structure (3) disposed in each of the elastic pin fixing holes (15) is inserted into a corresponding one of elastic pin engaging holes (13) defined on the watch strap (2) by spring elasticity, an end portion of the pressing structure (4) abuts against the end portion of the elastic pin structure (3) inserted into the corresponding one of the elastic pin engaging holes (13); wherein the pressing structure (4) comprises a pressing surface (7), pressing convexes (8) and a pressing clasp (9), the pressing convexes (8) and the pressing clasp (9) are positioned opposite to the pressing surface (7); the watch strap (2) is provided with a pressing counterbore (11), a pressing clasp receiving hole (12) communicated with the pressing counterbore (11), and the elastic pin engaging holes (13) matched with the pressing convexes (8) of the pressing structure (4); and a U-shaped groove (16) is provided on the connection head (5) to allow the pressing clasp (9) passing therethrough; wherein the pressing convexes (8) are located two opposite sides of the pressing clasp (9), and the elastic pin fixing holes (15) are located two opposite sides of the U-shaped groove (16); wherein each of the elastic pin structure (3) comprises an elastic pin (18), an elastic pin fixing column (10), and a spring (19) arranged between the elastic pin (18) and the elastic pin fixing column (10) to make the elastic pin (18) be movably connected with the elastic pin fixing column (10); the elastic pin (18) is positioned at an end of the elastic pin structure (3) and formed with an elastic pin buckle convex (17), the elastic pin fixing column (10) is formed with a limiting portion (6) matched with the elastic pin buckle convex (17), and the elastic pin fixing column (10) is received in the elastic pin fixing hole (15); wherein the pressing convexes (8) are inserted into the elastic pin engaging holes (13) respectively, an end of the pressing clasp (9) away from the pressing surface (7) is formed with a lug boss, the lug boss is fitted into the pressing clasp receiving hole (12) and positionally limited by the pressing counterbore (11), and a tail end of the elastic pin (18) abuts against one of the pressing convexes (8); wherein a height of the pressing convex (8) is equal to a depth of the elastic pin engaging hole (13); and the tail end of the elastic pin (18) is a curved surface structure.

* * * * *